US007175162B1

(12) United States Patent
Ratcliff

(10) Patent No.: US 7,175,162 B1
(45) Date of Patent: Feb. 13, 2007

(54) SCREW DRIVEN HOIST

(76) Inventor: Bruce E. Ratcliff, 1308 Sunny Slope Avene, Belmont, CA (US) 94002

( * ) Notice: Subject to any disclaimer, the term of this patent is extended or adjusted under 35 U.S.C. 154(b) by 394 days.

(21) Appl. No.: 10/635,792

(22) Filed: Aug. 6, 2003

(51) Int. Cl.
*B65H 77/00* (2006.01)

(52) U.S. Cl. ..... 254/231; 212/174

(58) Field of Classification Search ..... 254/231, 254/232, 233; 212/174, 171, 250, 225, 255, 212/271, 312, 341
See application file for complete search history.

(56) References Cited

U.S. PATENT DOCUMENTS

| | | | | | |
|---|---|---|---|---|---|
| 721,946 | A | * | 3/1903 | Foster | 254/231 |
| 1,261,590 | A | * | 4/1918 | Moore | 254/231 |
| 1,276,702 | A | * | 8/1918 | Anderson | 24/71.1 |
| 1,798,955 | A | * | 3/1931 | Schwerin | 254/231 |
| 2,075,239 | A | * | 3/1937 | Strange | 249/219.2 |
| 2,171,120 | A | * | 8/1939 | Bullard | 249/213 |
| 4,612,686 | A | * | 9/1986 | Bowers | 24/71.1 |
| 4,815,408 | A | * | 3/1989 | Burd | 114/109 |
| 4,901,775 | A | * | 2/1990 | Scott et al. | 140/123.5 |
| 5,623,751 | A | * | 4/1997 | Knutson | 24/71.1 |
| 5,971,178 | A | | 10/1999 | Ratcliff et al. | |

* cited by examiner

*Primary Examiner*—Emmanuel M Marcelo
(74) *Attorney, Agent, or Firm*—Thomas M. Freiburger

(57) ABSTRACT

A hoist provides high mechanical advantage and accurate positioning, driven by hand or with a powered rotary implement such as a drill. The hoist includes flexible tension members, such as chains, cables or straps, for applying force and tension to a load. A load nut is connected to the tension members for high mechanical advantage from rotational drive input to a load screw threadedly connected to the load nut. Alongside the tension members are guides forming channel-like spaces within which the flexible tension members travel. The guides, or portions of the guides, pass through the load nut in most forms of the invention.

18 Claims, 5 Drawing Sheets

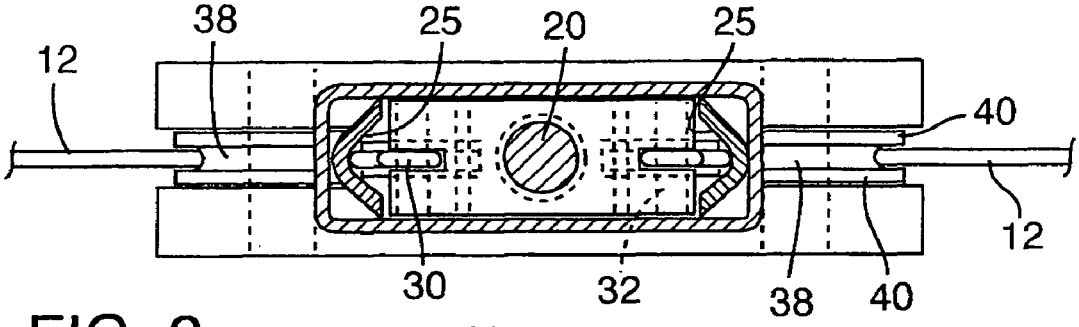
FIG. 2
FIG. 1
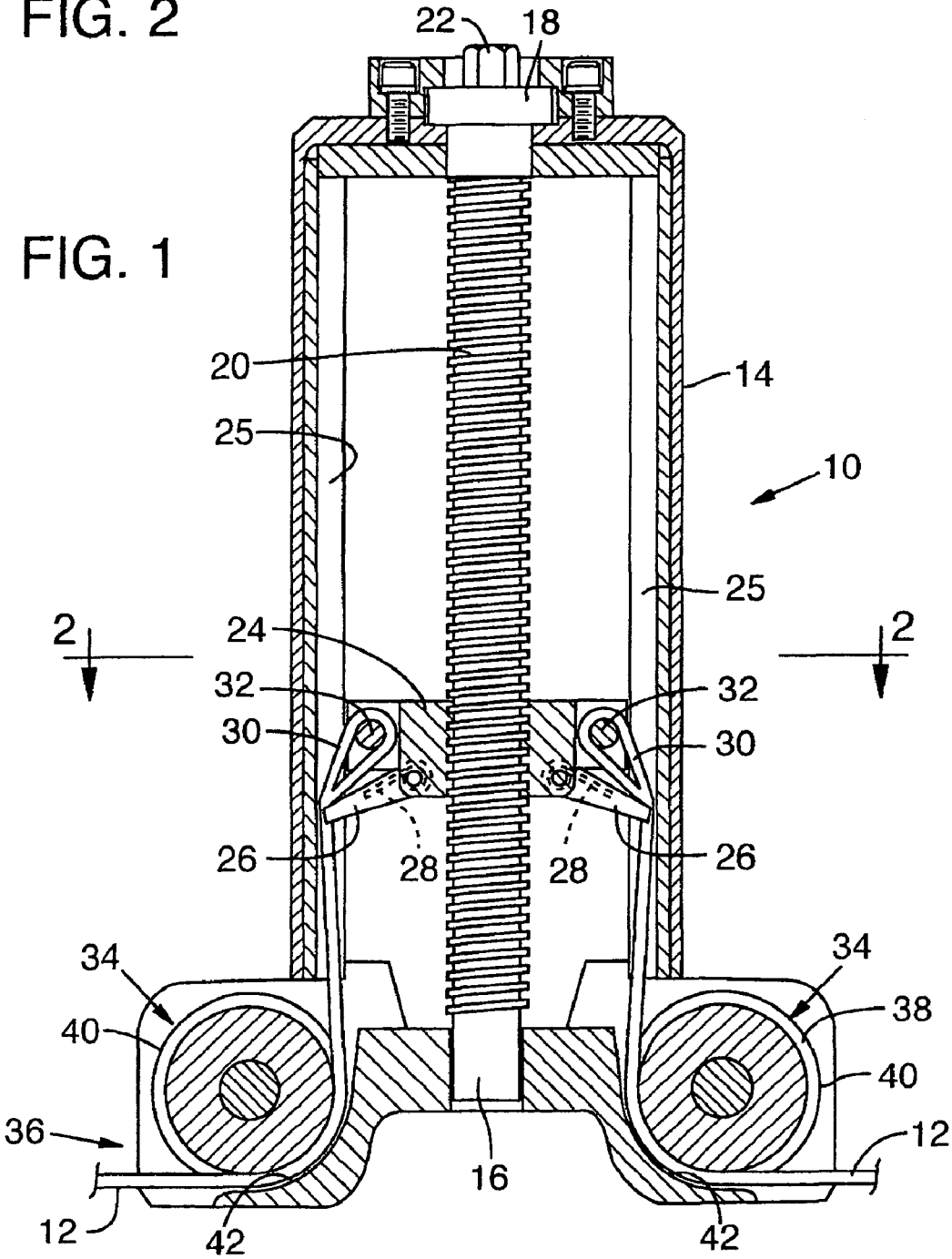

SCREW DRIVEN HOIST

BACKGROUND OF THE INVENTION

This invention concerns a hoist which receives a rotational input and applies tension to a pair of opposed flexible tension members with very high mechanical advantage. Hoists of this type include a screw gear which provides a positive hold of the applied tension force when the screw gear is not being driven.

Screw gear hoists are known. The applicant's own U.S. Pat. No. 5,971,178 shows a hoist of this type employing link-and-pin type chains (roller chains) drawn by a load nut or nut gear which is translated by a load screw or screw gear having a connection for receiving rotary input from a pneumatically powered impact tool or from a hand-powered tool.

Hoists of this type, with high mechanical advantage, can be used for lifting or repositioning a heavy load, for fine positional adjustment, or for load binding. Often they can be used in combination with an overhead electric hoist, secured to the bottom hook of such a hoist. The electric hoist lacks precision, and use of the screw hoist enables very precise final adjustment of position of a heavy load. For example, the hoist shown in the above patent can be designed to make an adjustment of about 0.001 inch with input rotation on the order of about one degree.

The term "hoist" as used herein and commonly in the industry, applies whether a load is moved vertically, horizontally or otherwise, or is not moved at all but is only subjected to tension. Improved hoists of this general type, using flexible tension members different from the roller chain disclosed in U.S. Pat. No. 5,971,178, and with guide members to maintain position of the tension members in the housing, form the subject matter of the invention described below.

SUMMARY OF THE INVENTION

Hoists of this invention have various types of flexible tension members, each with appropriate guides or guide channels for maintaining the tension members in position in the housing even when the tension members are slack or are being fed out of the housing without tension. The hoists of the invention have a fitting, accessible from the exterior of the housing, for attaching a hand tool to input rotation to the hoist, or for use of a powered tool such as a drill.

The tension members can be wire cables, coil chains, synthetic webbing straps, or other appropriate strong and flexible tension members. These tension members apply force to a load and, with the high mechanical advantage of the hoist, can move and position a load very accurately.

In one form of the invention, a pair of cables, or four or more cables, are secured to a load nut gear within the housing of the tool and pass over cable idler pulleys to extend in opposite directions from the housing. Guides for the cables comprise V grooves extending longitudinally in the housing, and preferably with a spring-biased means for pushing the cable into the V groove to maintain the cables in an orderly fashion in the housing, without kinking or twisting, when the wire cables are not in tension. Stationary pulley guides are located in close proximity to the edges flanges of the cable pulleys so that the cables cannot twist out of the pulley groves when not in tension.

A minimum of two such cables are included, but there could be two, three or more cables on each side, preferably with a V-groove and pulley for each such cable.

In another embodiment of the invention, coil chains are used, one in each side of the housing. Such coil chains generally comprise welded racetrack-shaped links which are interlinked in alternating orientations, the type used for log chains, many chain hoists and other heavy duty applications. In this case the pulleys of the cable embodiment are replaced with idler sprockets designed to smoothly engage with this type of chain. For guidance of chains within the housing, guide channels are provided at each side of the housing, closely guiding each chain within the housing, and with guides actually passing through the nut. The load nut has arms from which pins extend into and through the guide channels, engaging the end links of the chains. When the screw gear is back-rotated to pay chain out of the housing, the guide channels prevent bunching, kinking, or jamming and keep the chains in orderly arrangement for feeding out over the idler sprockets to the exterior of the housing.

In a third embodiment, synthetic webbing straps are employed as the tension members. The housing includes idler rollers or pulleys to feed the straps out of the housing in opposite directions, the ends of these straps being secured to arms of the load nut in the housing. As in the coil chain embodiment, the load nut arms have pins which extend into guide channels that maintain the webbing straps in non-kinked, relatively straight and orderly configuration within the housing even without tension in the straps and when the straps are being pushed out of the housing by back-rotation of the screw gear.

It is therefore among the objects of the invention to improve over prior high-mechanical-advantage precision screw hoists, with alternate forms of flexible tension members, properly guided within the housing of the tool. These and other objects, advantages and features of the invention will be apparent from the following description of preferred embodiments, considered along with the accompanying drawings.

DESCRIPTION OF THE DRAWINGS

FIG. 1 is an elevation or plan view in section showing a first embodiment of a hoist according to the invention, wherein wire ropes cables serve as the tension members.

FIG. 2 is a sectional view cut transversely through the longitudinal direction of the apparatus along the line 2—2 in FIG. 1.

DESCRIPTION OF PREFERRED EMBODIMENTS

Figure 4:
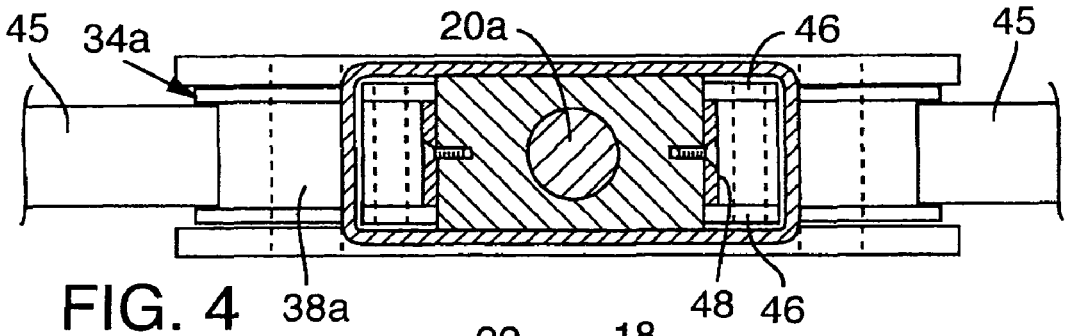
FIG. 4 is a transverse cross section view of the device of FIG. 3, the section being taken along the line 4—4 in FIG. 3.

FIGS. 1 and 2 show a screw gear hoist 10 of one embodiment of the invention, in this case utilizing wire rope, also known as wire cable or cable, as the tension members 12 of the hoist. In this form of the invention, a housing 14 provides a frame for the device and is generally elongated in shape as shown, providing bearings 16 and 18 at opposite ends for rotation of a screw gear or load screw 20 within the housing. The bearing 18 is a thrust bearing, only schematically shown in the drawings. Typically this will be a cylindrical roller thrust bearing. At a first end of the load screw is a tool head 22 for engagement by a tool for rotational input to the device. This could be a hand tool or a power tool such as a drill, for example. Threadedly connected to the load screw is a load nut 24, which moves in a longitudinal direction, with great mechanical advantage, when the load screw 20 is rotated.

In this embodiment the wire ropes or cables 12 are guided within the housing so as not to twist or kink in the housing when in a slackened condition. This occurs in the down status of the tool, where the operator is essentially trying to push on a rope, back-rotating the load screw 20 to push the cable out of the housing. To prevent twisting or kinking of the cable in this condition, there are provided a pair of V shaped grooves 25, at opposed sides of the interior of the housing and extending in the longitudinal direction as shown in FIGS. 1 and 2. The inner portions of the cables 12 are essentially confined within these V shaped grooves by a spring loaded cable positioner 26 on each side of the housing as shown. These cable positioners 26 are pivotally connected to the load nut 24 and have a spring, such as a coiled wire spring 28 shown in dashed lines, to bias the elements 26 to an outer position pushing the cables 12 toward the sides of the housing and into the V-grooves 25. These cable positioners 26 are effective only in the slack condition of the cables, when the operator spins the tool head 22 in the back-rotating direction and the load nut 24 pushes the cables out of the housing. On the other hand, under high tension each cable will overcome the spring and assume a taut, straight configuration within the housing.

As shown, each cable has a terminal end 30 which is connected to a suitable form of pin or hook 32 on the load nut 24. Each cable then leads down to an idler pulley 34 near the cable payout end 36 of the hoist device. These idler pulleys each have a peripheral groove 38 within which the cable 12 resides as it passes around approximately ¼ of the circumference of the pulley. Each annular groove 38 is formed by a pair of flanges 40, one of which is shown on each pulley in the view of FIG. 1, both flanges being shown in FIG. 2.

Closely adjacent to each idler pulley 34, in the area where the cable passes over the pulley, is a stationary pulley guide wall 42, formed as a component of the housing or frame. By closely approaching the flanges 40 of the pulleys, the guide wall 42 retains the wire rope or cable 12 within the pulley groove 38, preventing its escape therefrom even during slackened position or during payout on back-rotation of the load screw 20.

The hoist device of FIGS. 1 and 2 can employ more than one cable on each side. For two or three or more cables on each side, the housing as shown in FIG. 2 would become deeper, and the load nut would be secured to multiple cables on each side. Multiple spring-loaded positioners 26 would then be provided, as would multiple V-groove guides 25 on each side. The use of multiple cables on each side enables the load capability of the device to be increased without requiring heavier, stiffer cables, and can make the tool more compact because of commensurate smaller-diameter pulleys required.

Figure 3:
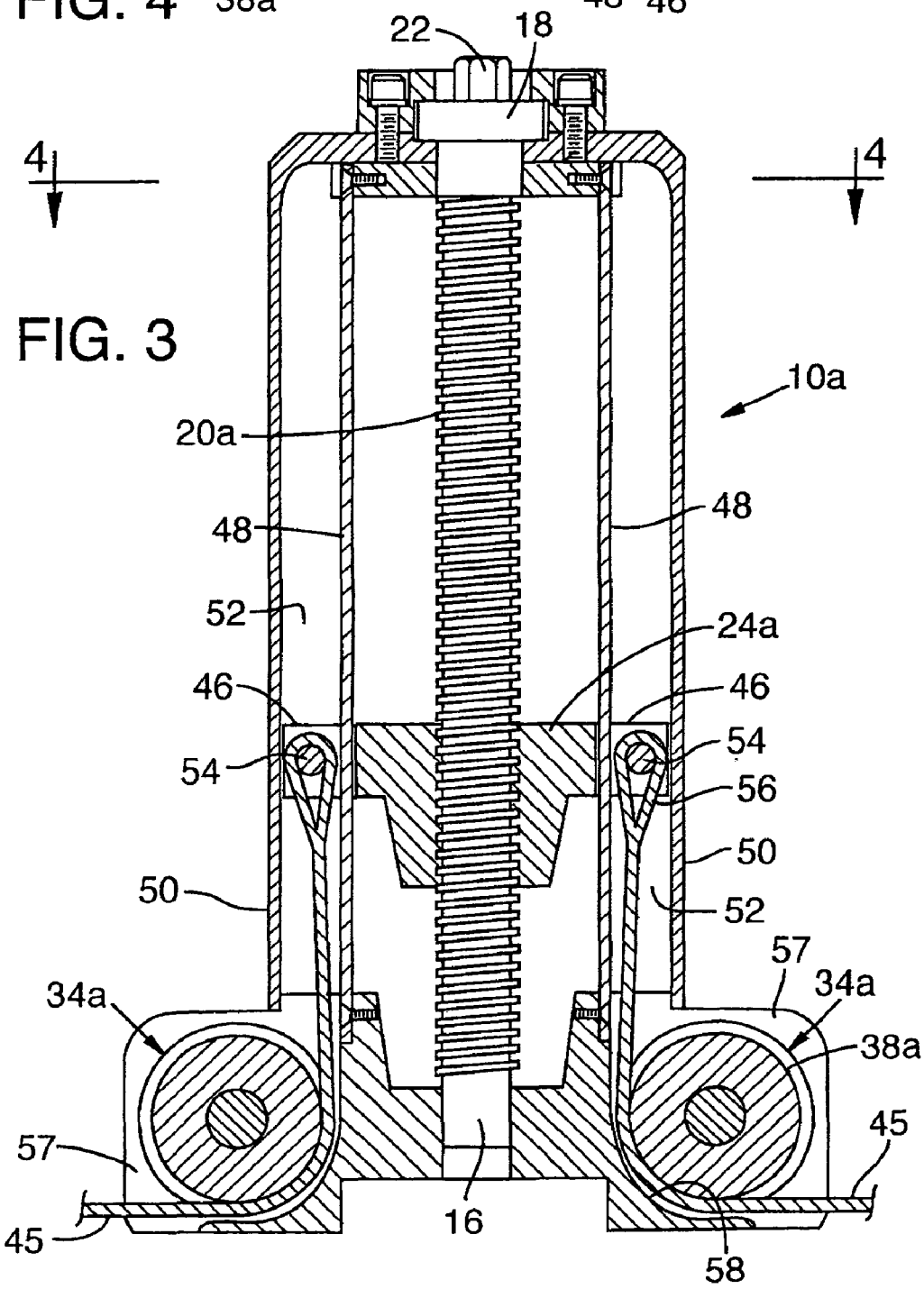
FIG. 3 is an elevation or plan view in section, showing a modified embodiment of the device with synthetic web straps as tension members.

FIGS. 3 and 4 show another form of the invention 10*a*. Taking first FIG. 3, this view can be considered as showing an alternative wire cable arrangement to what is shown in FIG. 1. In this case the tension members 45 are secured to the load nut 24*a* at or near outer ends of arms 46 of the load nut. A guide 48, which may be a flat bar, extends longitudinally and in spaced parallel relationship with a side wall 50 of the housing, at each side. This forms a channel-like space 52 within which the tension member moves when under tension and also when paying out the tension members 45 when the load screw 20*a* is back-rotated to move the load nut 24*a* closer to the head 22 of the load screw. Pins 54 extending transversely support the terminal ends 56 of the tension members 45. The arms 46 of the load nut 24*a* are split and spaced apart, extending at front and back of the flat bar guides 48 as viewed in FIG. 3. This is seen in FIG. 4, with the pin 54 (dashed lines) extending between the spaced arm sections 46.

Although FIG. 4 shows an embodiment with a synthetic web straps 45 as the tension members, and FIG. 3 is a view corresponding to FIG. 4, FIG. 3 can also be considered to show the wire ropes (cables) of FIG. 1 as guided in a different way, in the channels 52.

The synthetic webbing straps 45 of FIG. 4 are also illustrated in FIG. 3, as noted above. These straps extend around idler pulleys or rollers 34*a*, lying in a groove 38*a* of the pulleys, as in the cable embodiment of FIGS. 1 and 2. However, such pulley grooves can be eliminated if desired, relying on adjacent walls 57 to maintain the straps on the rollers 34*a*.

The straps extend out of the housing in opposite directions. When the load screw 20*a* is back-rotated to retract the load nut 24*a* toward the front of the housing, i.e. toward the screw head 22, the end sections of the webbing straps 45 are pushed through the channels 52 toward the exterior of the housing. In addition to preventing kinking or twisting during payout, the web guides 48, along with the housing, prevent the webbing straps from contacting the grease on the screw gear 20*a* and the load nut 24*a*, which is important because the webbing straps will be handled and will touch other objects when they are exterior to the hoist.

As in FIG. 1 embodiment, stationary pulley guides 58 preferably are included, essentially formed by curved walls positioned near the periphery of each pulley or roller 34*a*, to confine the web straps as illustrated. In this embodiment the strap guides 48 pass through an opening in the load nut 24*a*, the opening being defined between the two forks or legs of the load nut arm 46 and the pin 54.

Figure 6:
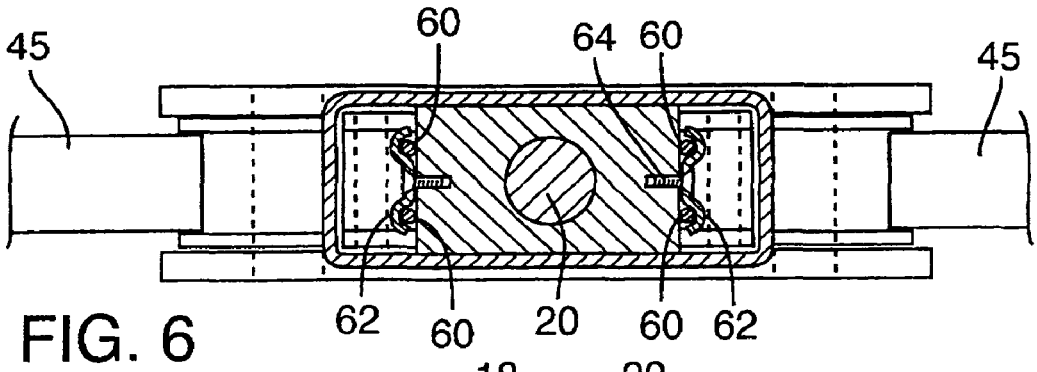
FIG. 6 is a sectional view as seen along the line 6—6 in FIG. 5.
Figure 5:
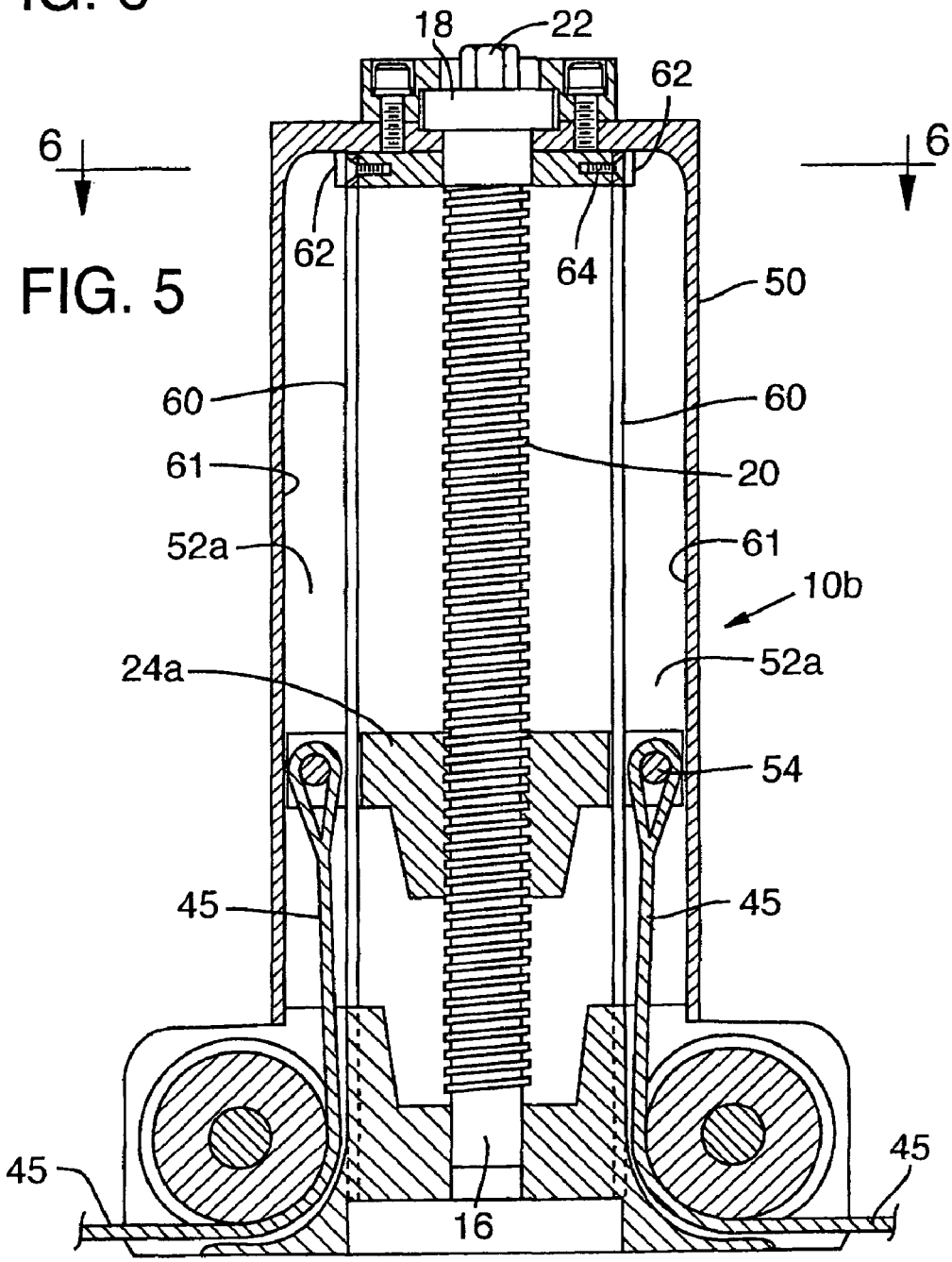
FIG. 5 is a sectional view similar to FIGS. 1 and 3 and showing a further embodiment of the invention.

FIGS. 5 and 6 show a hoist apparatus 10*b* with an alternative to the strap guides 48 shown in FIGS. 3 and 4. In this case the structure is primarily the same as what is shown in FIGS. 3 and 4, except that at each side of the housing 50 the strap guide comprises a pair of elongated, parallel, longitudinally-extending rods 60. FIG. 5 shows one of the rods at each side of the housing, and the sectional view of FIG. 6 shows both rods 60 at each side, in cross section. Since the webbing strap 45 has an appreciable width, a pair of parallel rods 60, at spacing approximately as shown in the drawings, are sufficient to act as one wall of a channel 52*a* (the housing wall 61 being the other); as in the previous embodiment, the guides pass through an opening in the load nut 24*a*. The rods 60 forming the strap guides can be secured to the housing in any appropriate way, and FIGS. 5 and 6 show generally U-shaped clamps 62 formed on brackets, two each bracket, for clamping these rods in place using a fastener 64 such as a machine screw.

Figure 8:
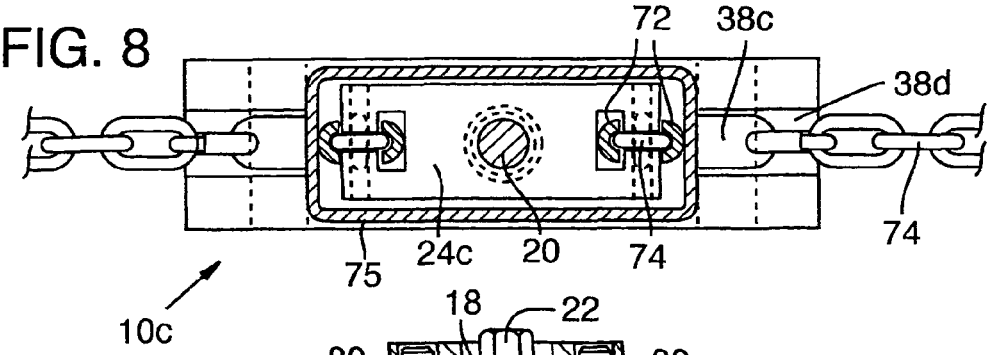
FIG. 8 is a sectional view of the embodiment of FIG. 7, as seen along the line 8—8 in FIG. 7.
Figure 7:
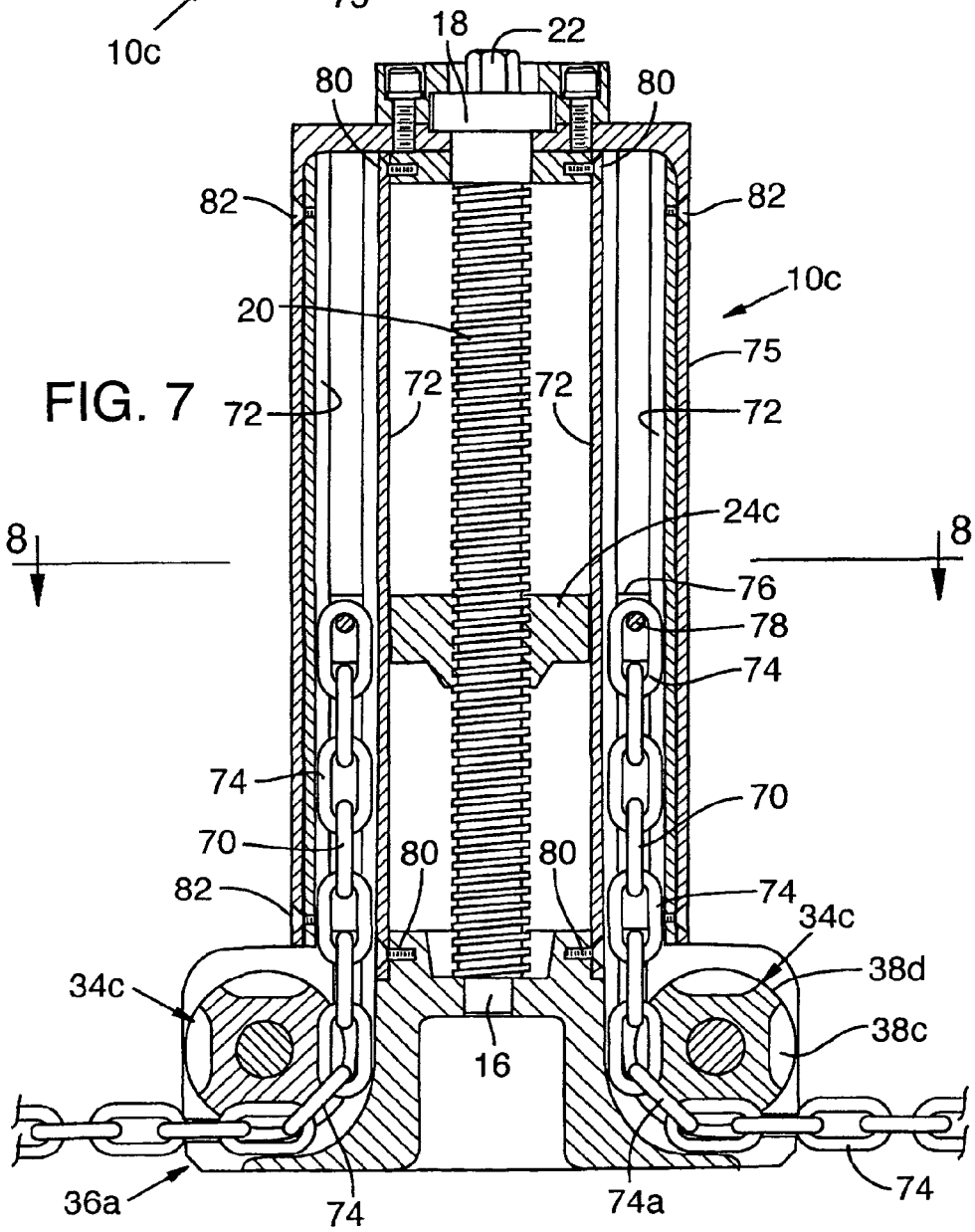
FIG. 7 is view similar to FIG. 5, showing another form of the hoist with coil chains as flexible tension members.
Figure 10:
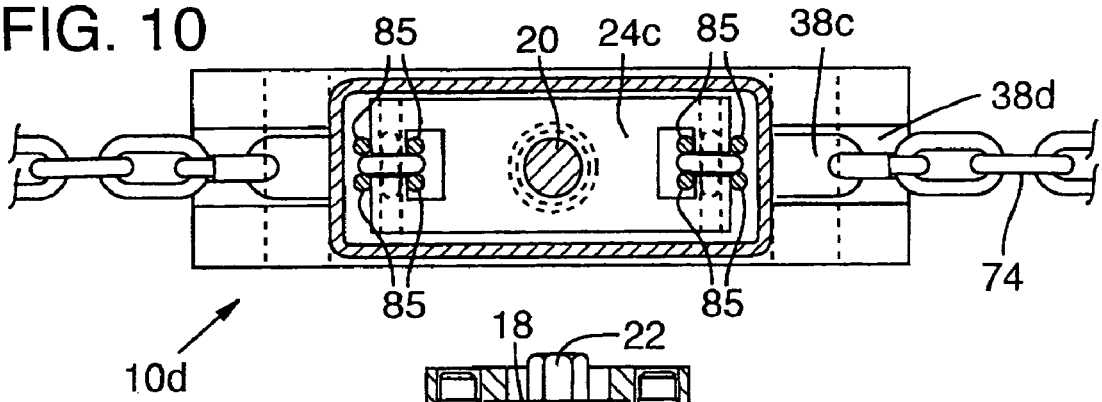
FIG. 10 is a sectional view of the FIG. 9 embodiment as seen along line 10—10 in FIG. 9.
Figure 9:
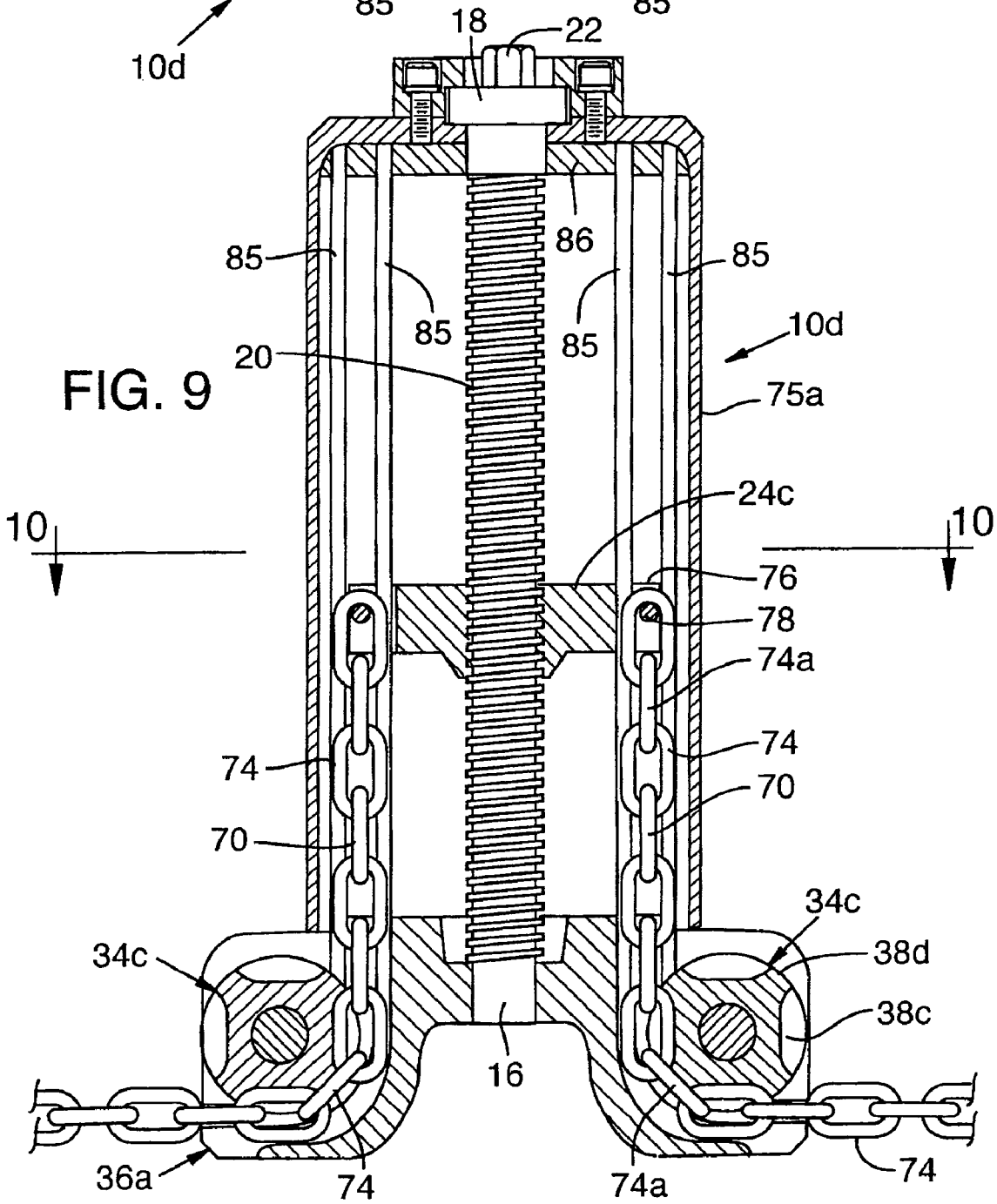
FIG. 9 is a sectional view similar to FIG. 7 showing a modification of the hoist shown in FIG. 7.

FIGS. 7 and 8 show a further form of the invention, in which coil chains 70 serve as the tension members. FIGS. 9 and 10 show a modified embodiment also with coil chains 70. In the form shown in FIGS. 7 and 8, chain guides within the housing comprise a pair of U-shaped longitudinal members 72 facing each other to capture alternate ones of the chain links 74 between them. The transverse sectional view of FIG. 8 shows the shape of these members 72 and how they trap the links 74 between them, with just enough space provided that the chain can freely slide through the guides. These elongated guides or channels are formed on both sides of the housing 75 of the hoist 10*c*, as shown in FIGS. 7 and 8.

Near the payout end 36*a* of the hoist unit 10*c* are rotationally-mounted idler sprockets 34*c*, of the type which are typically used in hoists that utilize chain of this type. The idler sprockets 34*c* have grooves 38*c* which seat alternate links 74 as show in FIG. 7, and bridges 38*d* between adjacent grooves 38*c*, to engage the alternating chain links 74*a*, as shown in the drawing.

The load nut 24*c* for this embodiment is similar to those described above, with one of the U-shaped guide components 72 passing through the load nut as shown particularly in FIG. 8. As in the embodiment described above, the left and right ends of the load nut 24*c* are bifurcated, with spaced arms or arm portions 76 extending in front of and behind the guide channel member 72 and a pin 78 extending between the two arms or arm portions 76 to engage with the chain 70.

The U-shaped guide elements 72 can be retained in the housing in any suitable fashion. In FIG. 7 these are shown retained by machine screws 80 and 82 to portions of the housing or frame.

Reviewing FIG. 7 it can be seen that the coil chains 70 are easily fed out of the housing when the chain is slack and especially during back-rotation of the screw gear 20 to feed chain out. Alternating links 74 of each chain are retained in the desired position and configuration, preventing bunching, kinking or jamming.

FIGS. 9 and 10 show an embodiment 10*d* very similar to that of FIGS. 7 and 8 but with a different type of chain guide. In this case the guides for the coil chain 70 comprise four guide rods 85 at each side of the housing. FIG. 10 shows the four rods 85 in section, at each side. These guide rods keep all links, both the orientation of the links 74 and the orientation links 74*a*, in substantially aligned configuration, as can be seen from the drawings. The guide rods 85 may be retained in the housing 75*a* in any appropriate manner. In FIG. 9 a plate 86 secured in the housing or frame has bores into which ends of the rods 85 are seated. The other ends of the rods can be secured in any suitable and efficient manner.

The above described preferred embodiments are intended to illustrate the principles of the invention, but not to limit its scope. Other embodiments and variations to this preferred embodiment will be apparent to those skilled in the art and may be made without departing from the spirit and scope of the invention as defined in the following claims.

I claim:

1. A hoist for accurately drawing a load comprising:

a housing providing a main frame for the hoist, an elongated load screw having external threads and mounted for rotation within the housing, a fitting on a first end of the load screw, accessible from outside of the housing and configured to receive a rotational driving input without longitudinal translation of the screw gear within the housing, a load nut having internal threads engaged with the external threads of the load screw so that rotation of the load screw causes the load nut to move longitudinally along the axis of rotation of the load screw, with the direction of movement of the load nut being dependent on the direction of rotation of the load screw, two wire cables, each having an inner end connected to the load nut within the housing and each having an outer end extending outside the housing, the two wire cables extending in opposite directions from the housing each for connection to a load, two idler pulleys connected in the housing for rotation and each in the path of one of the wire cables, the two idler pulleys having axes of rotation perpendicular to a plane containing the load screw and inner ends of the wire cables, each pulley having a peripheral groove for guiding a wire cable in tension, such that tension in the cables and motion of the cables in one direction due to rotation of the load screw is converted into said oppositely-directed motion and tension of the two cables outside the housing, cable guide means in the housing and positioned adjacent to the inner ends of the wire cables, for guiding and partially confining the wire cables as they move within the housing, and stationary pulley guides closely adjacent to an outer periphery of each of the idler pulleys to guide the wire cables in their passage around the pulleys and to generally retain the wire cables within the peripheral grooves of the idler pulleys even when not in tension.

2. The apparatus of claim 1, wherein the cable guide means within the housing comprises generally V shaped grooves extending longitudinally in the housing, each groove leading to one of the cable pulleys.

3. The apparatus of claim 1, wherein the load nut comprises a bar having two ends, each secured to one of the cable inner ends, the bar having a sufficient width to space the two cable inner ends significantly outward from the load screw, and including, near each end of the bar, a spring-loaded wire cable positioner bearing against the wire rope at a position on the wire cable spaced away from the connection with the bar and tending to push the wire cable into the cable guide means in the housing, thus keeping the two wire cables generally in position in the guides of the housing when little or no tension exists in the cables and when the load screw is rotated in a backing direction to feed cable out of the housing.

4. The apparatus of claim 3, wherein the cable guide means within the housing comprises generally V shaped grooves extending longitudinally in the housing, each groove leading to one of the cable pulleys.

5. The apparatus of claim 1, further including means connected to the load nut for generally maintaining the wire cables spaced apart and in an outward position away from the load screw within the housing.

6. The apparatus of claim 5, wherein said means for generally maintaining the wire cables comprises the load nut having a width sufficient to space the two wire cables apart, each significantly spaced away from the load screw, an elongated V shaped groove partially surrounding and confining each of the wire cables at their inner ends within the housing, and means on the load nut for generally maintaining the wire cables within the V grooves within the housing.

7. The apparatus of claim 1, including at least two cables on each side of the load nut, and one of said cable guide means and pulley for each cable.

8. A hoist for accurately drawing a load comprising:

a housing providing a main frame for the hoist, an elongated load screw having external threads and mounted for rotation within the housing, a fitting on a first end of the load screw, accessible from outside of the housing and configured to receive a rotational driving input without longitudinal translation of the screw gear within the housing, a load nut having internal threads engaged with the external threads of the load screw so that rotation of the load screw causes the load nut to move longitudinally along the axis of rotation of the load screw, with the direction of movement of the load nut being dependent on the direction of the rotation of the load screw, two coil chains, each having an inner end connected to the load nut within the housing and each having an outer end extending outside the housing, the two coil chains extending in opposite directions from the housing each for connection to a load, two idler sprockets connected in the housing for rotation and each in the path of one of the coil chains, the two idler sprockets having axes of rotation perpendicular to a plane containing the load screw and inner ends of the coil chains, each sprocket having peripheral grooves or recesses for guiding a coil chain in tension, such that tension in the chains and motion of the chains in one direction due to rotation of the load screw is converted into said oppositely-directed motion and tension of the two chains outside the housing, and chain guide means in the housing and positioned adjacent to the inner ends of the coil chains, for guiding and partially confining the coil chains as they move within the housing.

9. The apparatus of claim 8, wherein the chain guide means within the housing comprises spaced-apart, parallel, elongated, longitudinally-extending members generally U-shaped in cross section, positioned to envelop and confine alternate links of each coil chain for sliding movement along the U-shaped members at each side of the housing.

10. The apparatus of claim 9, further including stationary sprocket guides closely adjacent to each of the idler sprockets to guide the coil chains in their passage around the sprockets and to generally retain the chains within the grooves or recesses of the idler sprockets even when not in tension.

11. The apparatus of claim 8, wherein the chain guide means within the housing comprises spaced apart, parallel, elongated, longitudinally-extending rods, four adjacent to each chain, positioned to confine the links of each chain against substantial transverse movement within the housing.

12. The apparatus of claim 11, further including stationary sprocket guides closely adjacent to each of the idler sprockets to guide the coil chains in their passage around the sprockets and to generally retain the chains within the grooves or recesses of the idler sprockets even when not in tension.

13. A hoist for accurately drawing a load comprising:

a housing providing a main frame for the hoist, an elongated load screw having external threads and mounted for rotation within the housing, a fitting on a first end of the load screw, accessible from outside of the housing and configured to receive a rotational driving input without longitudinal translation of the screw gear within the housing, a load nut having internal threads engaged with the external threads of the load screw so that rotation of the load screw causes the load nut to move longitudinally along the axis of rotation of the load screw, with the direction of movement of the load nut being dependent on the direction of rotation of the load screw, two synthetic web straps, each having an inner end connected to the load nut within the housing and each having an outer end extending outside the housing, the two synthetic web straps extending in opposite directions from the housing each for connection to a load, two idler pulleys connected in the housing for rotation and each in the path of one of the synthetic web straps, the two idler pulleys having axes of rotation perpendicular to a plane essentially containing the load screw and inner ends of the synthetic web straps, each pulley guiding a synthetic web strap in tension, such that tension in the straps and motion of the straps in one direction due to rotation of the load screw is converted into said oppositely-directed motion and tension of the two straps outside the housing, and strap guide means in the housing, for guiding and partially confining the synthetic web straps as they move within the housing.

14. The apparatus of claim 13, further including stationary pulley guides closely adjacent to an outer periphery of each of the idler pulleys to guide the web straps in their passage around the pulleys and to generally retain the straps along the idler pulleys even when not in tension.

15. The apparatus of claim 13, wherein the strap guide means within the housing comprises the load nut having a substantial width extending in opposite directions, the two web straps being secured near ends of the arms of the load nut and each web strap being adjacent to a wall of the housing positioned outwardly from the load nut and from the web strap, and a flat bar guide adjacent to each web strap, each bar guide spaced inwardly, toward the load screw, from said wall of housing and each bar guide passing through the load nut, each bar guide being parallel to a said wall of the housing and forming with said wall an elongated channel for containing the web strap within the housing.

16. The apparatus of claim 13, wherein the strap guide means within the housing comprises, at each of two sides of the housing, a pair of guide rods spaced inwardly from a wall of the housing and providing a generally elongated channel within the housing within which a web strap is positioned, for confining in guiding the web strap within the housing, the load nut having a substantial width, with two arms extending in opposite directions and reaching to positions adjacent to opposite said walls of the housing, the web straps being secured to the load nut near outer ends of said arms, and the guide rods passing through the load nut, just inwardly from the connections with the web straps.

17. A hoist for accurately drawing a load comprising:

a housing providing a main frame for the hoist, an elongated load screw having external threads and mounted for rotation within the housing, a fitting on a first end of the load screw, accessible from outside of the housing and configured to receive a rotational driving input without longitudinal translation of the screw gear within the housing, a load nut having internal threads engaged with the external threads of the load screw so that rotation of the load screw causes the load nut to move longitudinally along the axis of rotation of the load screw, with the direction of movement of the load nut being dependent on the direction of rotation of the load screw, two flexible tension members, each having an inner end connected to the load nut within the housing and each having an outer end extending outside the housing, the two flexible tension members extending in opposite directions from the housing each for connection to a load, two idler pulleys connected in the housing for rotation and each in the path of one of the flexible tension members, the two idler pulleys having axes of rotation perpendicular to a plane essentially containing the load screw and inner ends of the flexible tension members, each pulley guiding a flexible tension member in tension, such that tension in the tension members and motion of the tension members in one direction due to rotation of the load screw is converted into said oppositely-directed motion and tension of the two tension members outside the housing, and tension member guide means in the housing, for guiding and partially confining the flexible tension members as they move within the housing, including preventing the flexible tension members from contact with the load screw even during back-rotation of the load screw effective to feed the tension members out of the housing.

18. The apparatus of claim 17, wherein at least a part of the tension member guide means for each tension member passes through the load nut.

* * * * *